United States Patent [19]

Davies

[11] Patent Number: 4,554,981

[45] Date of Patent: Nov. 26, 1985

[54] TUBING PRESSURIZED FIRING APPARATUS FOR A TUBING CONVEYED PERFORATING GUN

[75] Inventor: David L. Davies, Abu Dhabi, United Arab Emirates

[73] Assignee: Hughes Tool Company, Houston, Tex.

[21] Appl. No.: 751,999

[22] Filed: Jul. 5, 1985

Related U.S. Application Data

[63] Continuation of Ser. No. 518,910, Aug. 1, 1983, abandoned.

[51] Int. Cl.[4] ..... E21B 43/11

[52] U.S. Cl. ..... 175/4.52; 175/4.54; 175/4.56; 166/55.1; 166/297

[58] Field of Search ..... 175/4.52, 4.54, 4.56, 175/4.58; 166/55.1, 297, 239; 89/1 C; 285/3, 18, 319

[56] References Cited

U.S. PATENT DOCUMENTS

| | | | |
|---|---|---|---|
| Re. 30,829 | 12/1981 | Trott | 166/297 |
| 2,866,508 | 12/1958 | Church | 166/55 |
| 2,876,701 | 3/1959 | Long | 89/1 C |
| 2,876,843 | 3/1959 | Huber | 175/4.58 |
| 3,148,894 | 9/1964 | Schwab | 285/18 |
| 3,189,094 | 6/1965 | Hyde | 166/55.1 |
| 3,706,344 | 12/1972 | Vann | 166/297 |
| 3,800,705 | 4/1974 | Tamplen | 175/4.54 X |
| 3,912,013 | 10/1975 | Vann | 175/4.56 X |
| 4,066,282 | 1/1978 | Vann | 285/319 X |
| 4,322,384 | 2/1983 | Kinney | 166/278 |

*Primary Examiner*—Stephen J. Novosad
*Assistant Examiner*—Hoang C. Dang
*Attorney, Agent, or Firm*—Robert A. Felsman; Charles D. Gunter, Jr.

[57] ABSTRACT

A tubing pressurized firing apparatus is shown for use with a tubing conveyed perforating gun of the type used to perforate a cased well bore. The firing apparatus has a tubular body with an upper end for connection in the well tubing string and with a lower end for connection to a well perforating gun. An inner mandrel is slidably mounted within the tubular body and has a ball seat formed in the interior bore thereof for receiving a ball dropped through the well tubing string. The ball and ball seat together form a pressure tight seal whereby tubing pressure in the well tubing string acts on the inner mandrel to slide the mandrel downwardly within the tubular body. A cocking mechanism located below the inner mandrel within the body includes a lockout member which is initially positioned between a detonating pin and a percussion detonator. The cocking mechanism is actuated by downward sliding movement of the inner mandrel to move the lockout member from between the detonating pin and percussion detonator whereby a subsequent release of tubing pressure and upward sliding movement of the inner mandrel exposes the detonating pin to the percussion detonator to actuate the detonator and fire the perforating gun.

23 Claims, 9 Drawing Figures

TUBING PRESSURIZED FIRING APPARATUS FOR A TUBING CONVEYED PERFORATING GUN

This application is a continuation of application Ser. No. 518,910, filed Aug. 1, 1983, now abandoned.

BACKGROUND OF THE INVENTION

The present invention relates generally to firing devices of the type used to fire perforating guns used to perforate a cased well bore for the production of well bore fluids and, specifically, to a tubing pressurized firing device for firing a tubing conveyed perforating gun responsive to changes in the fluid pressure within the well bore tubing string.

As oil and gas well bores are drilled, the integrity of the borehole is preserved, usually by cementing a casing or liner in place in the borehole. The casing or liner is a metal, cylindrical conduit which must be punctured or perforated over the desired interval in order to produce well bore fluids once drilling is complete. A perforating gun which utilizes some form of fired projectile and an explosive charge is used to perforate the casing or liner to begin production from the well. Prior perforating gun techniques have either utilized tools which were run on a wireline or cable or were tubing conveyed devices which were run on a tubing string to the desired depth in the well bore.

Several problems exist with wireline run perforating gun systems. Wireline methods require a delicate balance between expected formation pressure and the drilling mud or fluid used to provide a balanced hydrostatic head in the well bore. A miscalculation of the expected formation pressure can result in a tangled wireline which necessitates pulling the tubing under adverse high pressure conditions. If an over balanced pressure condition exists during the perforation step, the well can loose large volumes of fluid into the surrounding formation which can damage the formation. Also, proper pressure differentials are needed to effectively clean the perforations. It is difficult with the wireline system to obtain the pressure differential needed to back surge the perforations and provide a clean well which will produce high yields. It is also difficult to use wireline systems in deviated well bores.

The tubing conveyed perforating gun generally allows immediate safe release of formation pressure at maximum pressure differentials into the tubing string. The back-surge which results tends to clean the perforation of mud filtrate, cement, and other perforating debris. With tubing conveyed perforating systems, the tubing can be run into position, a packer set to seal off a well bore, and the surface wellhead equipment can be installed. The packer setting can be checked by circulating fluid under pressure through the well annulus or through the well tubing string. Once the topside work is completed and tested for safety, the perforating gun can be fired to bring in the well. Since all surface work is completed before the perforating gun is fired, operating safety is enhanced.

In spite of these advantages, prior tubing conveyed perforating guns have lacked the ideal detonating system. Prior systems were usually detonated by (1) a bar dropped through the tubing string to fire a percussion detonator, (2) a through-the-tubing wireline connection system using an electrical charge to detonate the gun; or (3) well annulus pressurized systems which were actuated by fluid pressure acting through ports in the tubing string located above the packer. The first of these two systems required a wireline run in order to set a hydraulic packer to seal off the well bore. The third system mentioned above could only be used with a mechanically set well packer or a previously set permanent packer. Also, there was no satisfactory delay mechanism for the detonator of the gun.

SUMMARY OF THE INVENTION

The tubing pressurized firing apparatus of the invention is designed for use with a tubing conveyed perforating gun of the type used to perforate a cased well bore. The firing apparatus includes a tubular body having an upper end with upper connecting means for connecting the body in a well tubing string and has a lower end with a lower connecting means for connecting the body to a well perforating gun. An actuator means is located within the tubular body and is responsive to changes in pressure within the well tubing string above the tubular body. A cocking means located below the actuator means within the tubular body includes a lockout member which is initially positioned between a detonating pin and a percussion detonator. The cocking means is actuable by the actuator means to move the lockout member from between the detonating pin and percussion detonator as tubing pressure is increased by a predetermined amount. The subsequent release of tubing pressure exposes the detonating pin to the percussion detonator to actuate the detonator and fire the perforating gun.

The actuator means is preferably an inner mandrel which is slidably mounted within the tubular body and which sealingly engages the tubular body. The inner mandrel has an interior bore for communicating with the well tubing string above the body. The mandrel interior bore has a ball seat formed therein for receiving a ball dropped through the well tubing string. The ball and ball seat together form a pressure tight seal whereby tubing pressure in the well tubing string acts on the inner mandrel to slide the mandrel downwardly within the tubular body and thereby act on the cocking means.

DETAILED DESCRIPTION OF THE INVENTION

Figure 4:
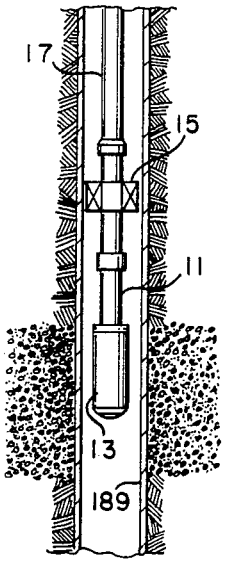
FIG. 4 is a schematic view of the apparatus of the invention being run into position within a well bore on a well tubing string.

Turning to FIG's. 1*a*–1*b*, there is shown a tubing pressurized firing apparatus of the invention designated generally as 11. The tubing pressurized firing apparatus 11 is adapted to be used with a tubing conveyed perforating gun of the type known in the art which is used to perforate a cased well bore. FIG. 4 shows a simplified, schematic view of a typical perforating system which includes a perforating gun 13 which is coupled to a firing apparatus 11, both of which are run below a well packer 15 which is carried on a well tubing string 17 extending to the surface.

Figure 1A:
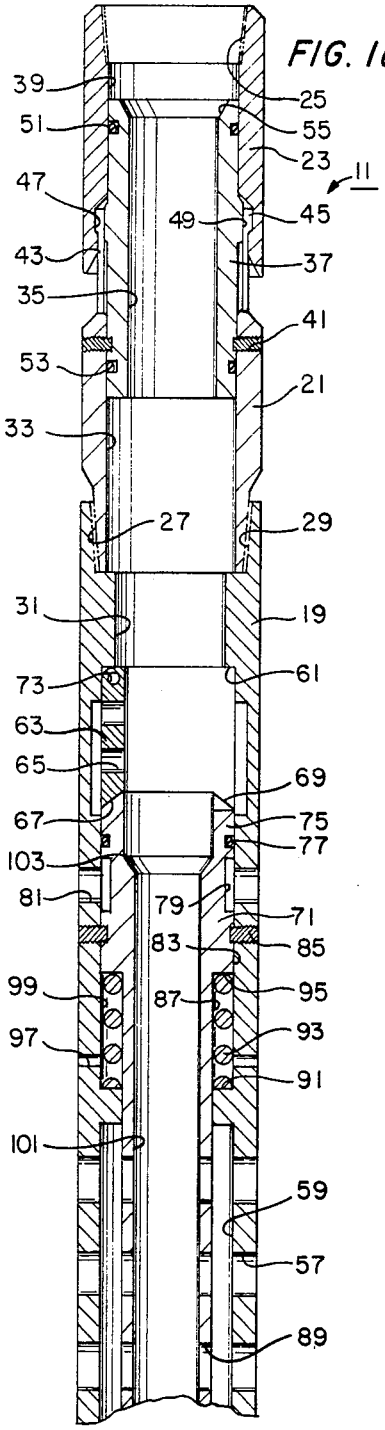
FIG. 1*a* is a side cross-sectional view of a firing apparatus of the invention in the running-in position.

The firing apparatus 11, as shown in FIG. 1*a*, includes a tubular body 19 having an upper end 21 with upper connecting means such as an upper sub 23 with a threaded interior 25 for connection with a mating threaded connector of a tubing string. Upper end 21 has a threaded exterior surface 27 which matingly engages the internally threaded surface 29 of tubular body 19. Tubular body 19 has an inner bore 31 which communicates with the bore 3 of upper end 21 and through the internal bore 35 of a shift sleeve 37 with the bore 39 of upper sub 23. Upper sub 23 communicates with the internal bore of the tubing string (17 in FIG. 4) and through the tubing string with the well surface.

Upper end 21 is connected to shift sleeve 37 by one or more shear pins 41. Upper end 21 also has formed thereon detent means such as collet fingers 43. Collet fingers 43 have dog portions 45 at the end thereof which are adapted to be received within an annular recess 47 provided in the lower end of the upper sub 23. Shift sleeve 37 includes a raised exterior region 49 which underlies and retains the collet dog portions 45 within the upper sub recess 47 in the position shown in FIG. 1*a*. An O-ring seal 51 in the shift sleeve exterior surface sealingly engages the upper sub bore 39 and an O-ring seal 53 similarly sealingly engages the bore 33 of the upper end 21. Shift sleeve 37 also has a ball seat 55 formed in the upper end thereof for receiving and sealingly engaging a ball dropped through the tubing string from the surface.

Figure 2A:
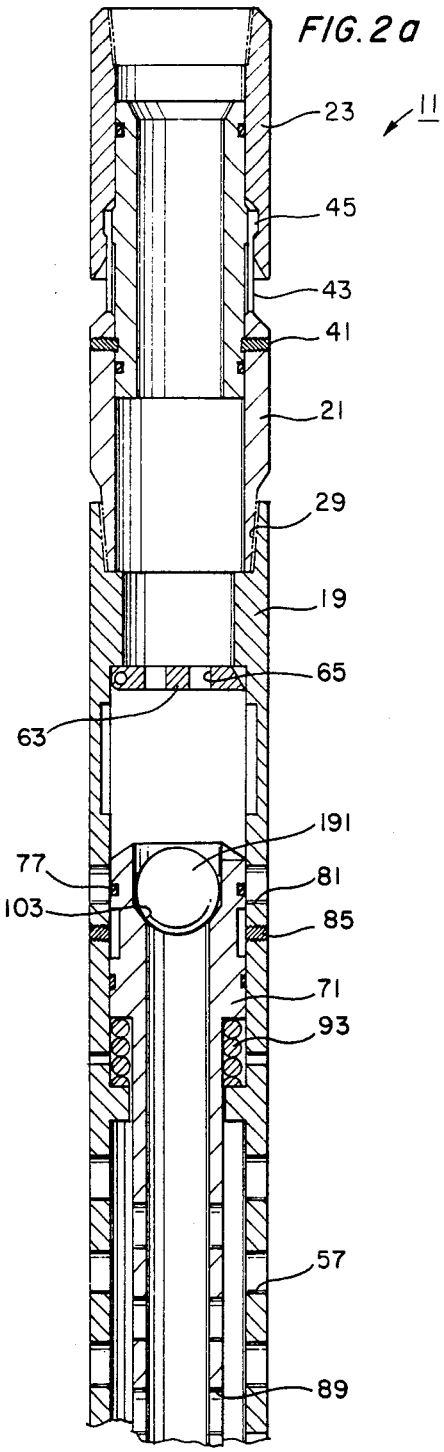
FIG. 2*a* is a side cross-sectional view, similar to FIG. 1*a* but showing the apparatus in the cocked position.

Tubular body 19 is a generally cylindrical member having a ported region with a plurality of vent ports 57 which communicate the well bore with the interior 59 thereof. The tubular body upper end includes an internal shoulder 61 as a part of inner bore 31. A flapper valve 63 is mounted adjacent shoulder 61 and is movable between a retracted position as shown in FIG. 1*a* and an extended position as shown in FIG. 2*a* which obstructs the bore 31 of body 19. Flapper valve 63 includes vent ports 65. Flapper valve 63 is normally spring biased toward the extended position shown in FIG. 2*a* and is held in the position shown in FIG. 1*a* by the contact between the outer edge 67 of the flapper valve and the leading edge 69 of an inner mandrel 71. Flapper valve 63 pivots between the retracted and extended positions about a pivot point 73.

The inner mandrel 71 is an actuator means located within the tubular body 19 which is responsive to changes in pressure within the well tubing string above the tubular body 19, as will be described. Inner mandrel 71 includes a cylindrical portion 75 having an O-ring seal 77 which is slidable with and seals against the interior of tubular body 19. The cylindrical portion 75 is joined to a reduced external diameter region 79 which, in the position shown in FIG. 1*a*, communicates with vent ports 81 in the tubular body 19. The region of reduced external diameter 79 increases in diameter in the adjoining region 83 and is initially secured to the tubular body 19 by means of a plurality of shear screws 85. The region 83 is joined to a depending cylindrical portion 87 of the inner mandrel 71 which portion includes a vented region having a plurality of vent ports 89 which are generally aligned with and communicate with the vent ports 57 in tubular body 19.

Tubular body 19 includes an internal shoulder 91 for receiving a coil spring 93 the other end of which contacts an external shoulder 95 of inner mandrel 71, whereby mandrel 71 is biased in the upward direction. An exhaust port 97 communicates the spring cavity 99 with the surrounding well bore.

The inner mandrel 71 also has an interior bore 101 which communicates with the well tubing string and which has a ball seat 103 formed at the upper extent thereof for receiving a ball dropped through the well tubing string from the surface. The ball seat 103 of inner mandrel 71 is of lesser diameter than the ball seat 55 of the upper sub 23.

Figure 1B:
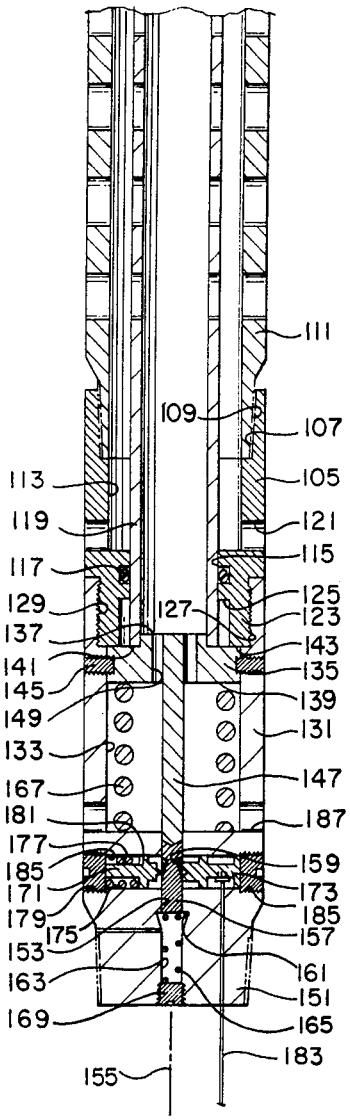
FIG. 1*b* is a downward continuation of FIG. 1*a* showing the actuator and cocking mechanism of the apparatus.

As shown in FIG. 1*b*, the firing apparatus 11 includes a cylindrical connecting sub 105 which has an internally threaded surface 107 for threadedly engaging the exterior threaded surface 109 of the lower extent 111 of tubular body 19. The connecting sub 105 has an internal bore 113 which is joined to a region of decreased diameter 115 having an O-ring seal 117 for sealingly engaging the inner mandrel lower end 119 when in the position shown in FIG. 1*b*. A plurality of debris ports 121 communicate the internal bore 113 with the surrounding well annulus. The region of decreased diameter 115 joins a lower portion 123 of the connecting sub 105 forming an internal shoulder 125.

The lower portion 123 of connecting sub 105 has an externally threaded surface 127 which matingly engages the internally threaded surface 129 of a lower body sub 131. Lower sub 131 includes an internal bore 133 adapted to slidably receive a cocking means including a perforated disc 135 having an upper surface 137 and a lower surface 139. The upper surface 137 has a stepped down region 141 which contacts the lower end 119 of inner mandrel 71. The upper surface 137 also contacts a lip 143 formed by the lower portion 123 of the connecting sub 105.

Perforated disc 135 is initially fixed to the lower sub 131 by a plurality of shear screws 145. The perforated disc 135 has a downwardly extending leg 147 extending from the approximate center point of the lower surface 139. The perforated disc 135 also includes fluid passages 149 which communicate the bore 113 of the lower sub 131 with the bore 101 of the inner mandrel 71.

The lower sub 131 has a generally solid end portion 151 which is transversed by a longitudinal channel 153, the channel 153 being located on the longitudinal center line 155 of the tubular body 19. As shown in FIG. 1*b*, the leg 147 of perforating disc 135 is received within the channel 153. A lockout member, such as the cylindrical plug 157 is located below the perforated disc leg within the channel 153 and includes at least one outwardly biased dog 159. The dog 159 is adapted to engage a shoulder region 161 in the lower extent 163 of the channel 153 when the inner mandrel 71 moves downwardly and acts on the perforated disc upper surface 137. The lockout member 157 is normally biased upwardly by the coil spring 165 located within the channel lower extent 163 and the perforated disc 135 is normally biased upwardly by the coil spring 167 located within bore 133. A plug 169 is threadedly received within the lower extent 163 of channel 153 to hold the coil spring 165 in place.

The cocking mechanism located below the inner mandrel 71 also includes a detonating pin 171 and a percussion detonator 173 which are installed within a transverse channel 175 which intersects the lower sub channel 153 as shown in FIG. 1*b*. In the position shown, the detonating pin 171 and percussion detonator 173 are located on opposite sides of the lockout member 157. A coil spring 177 located between an end plug 179 and an internal shoulder 181 on the pin 171 biases the detonating pin 171 in the direction of the percussion detonator 173. The percussion detonator 173 is actuable upon being contacted by the detonating pin 171 to ignite the primer cord 183 which in turn passes to the explosive charge (not shown) of a standard perforating gun which is located below the apparatus 11. The percussion detonator 173 is side-mounted within the transverse channel 175 and is accessible by means of a threaded end plug 185 to facilitate replacement without the necessity of disassembling the other components of the apparatus. A plurality of debris ports 187 are located above the transverse channel 175 in the lower sub 131 and communicate the bore 133 with the surrounding well bore.

The operation of the present invention will now be described. As shown in FIG. 4, the firing apparatus 11 and perforating gun 13 are run to the proper depth in a well bore which is lined by a casing 189. As shown in FIG's. 1*a* and 1*b*, well fluids are allowed to circulate through the vent ports 57 and 89 and up the tubing string to fill the tubing. Once the desired depth is reached, fluid is circulated downwardly through the tubing string and out through the vent ports 89, 57 into the well bore to provide the desired hydrostatic head within the well. All wellhead installation at the surface can then be completed and tested for safety.

FIG's. 1*a* and 1*b* show the firing apparatus 11 in the running-in position. The inner mandrel 71 is shear pinned by pins 85 in place below its fully extended length of travel with the coil spring 93 slightly compressed. The cylindrical portion 75 of the inner mandrel, which acts as a piston section, straddles the vent ports 81 with O-ring 77 providing a fluid seal to prevent communication between the interior bore 101 of the mandrel and the vent ports. The flapper valve 63 is retained in the retracted vertical position due to engagement of the outer edge 67 thereof with the leading edge 69 of the inner mandrel 71. Perforated disc 135 is pinned in place by shear pins 145 and the lockout member 157 separates the detonating pin 171 from the percussion detonator 173.

Figure 2B:
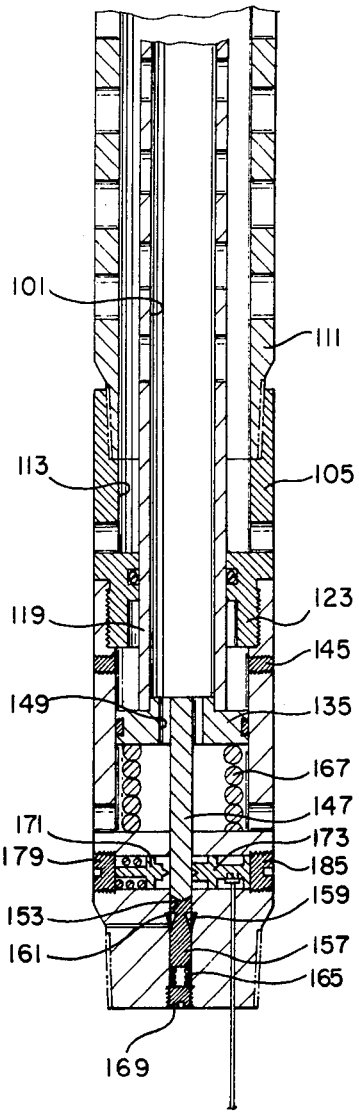
FIG. 2*b* is a downward continuation of FIG. 2*a*.
Figure 5:
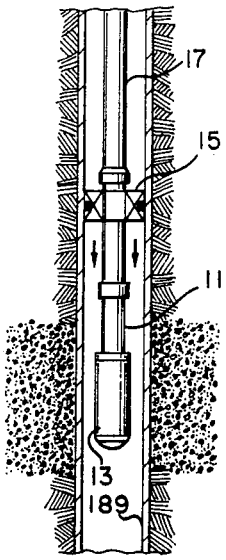
FIG. 5 is a schematic view similar to FIG. 4 showing a well packer on the well tubing string which has been actuated to seal off the well bore.
Figure 6:
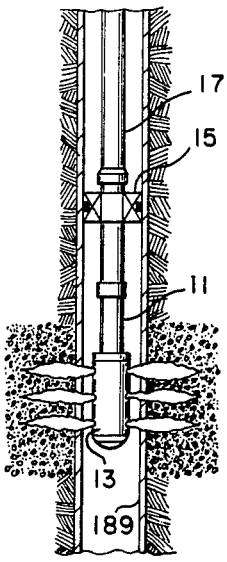
FIG. 6 is a schematic view of the apparatus showing the firing of the perforating gun.

The smaller of two balls is then dropped through the tubing string and seats in the ball seat 103 of the inner mandrel 71. This serves to block off communication with the well annulus through the ports 89, 57 and the tubing string can then be pressured-up from the surface. Pressuring the tubing string to a first pre-determined level, sets the well packer (15 in FIG. 5), and fluid can be circulated down the well annulus to check the packer set. Pressure inside the tubing string is then raised to a second pre-determined level, higher than the first level, which forces the inner mandrel 71 downwardly, shearing the pins 85, compressing the spring 93, releasing the flapper valve 63 and forcing the lockout member 157 downwardly in the channel 153 (FIGS. 2*a*–2*b*). As best seen in FIG. 2*b*, the perforated disc 135 has been moved downwardly by the lower end 119 of the inner mandrel thereby shearing the shear screws 145 and compressing the coil spring 167. As the lockout member 157 travels downwardly in the channel 153, the coil spring 165 is compressed and the spring loaded dogs 159 expand outwardly to engage the undercut shoulder regin 161 thereby retaining the lockout member in the position shown in FIG. 2*b*.

Figure 3A:
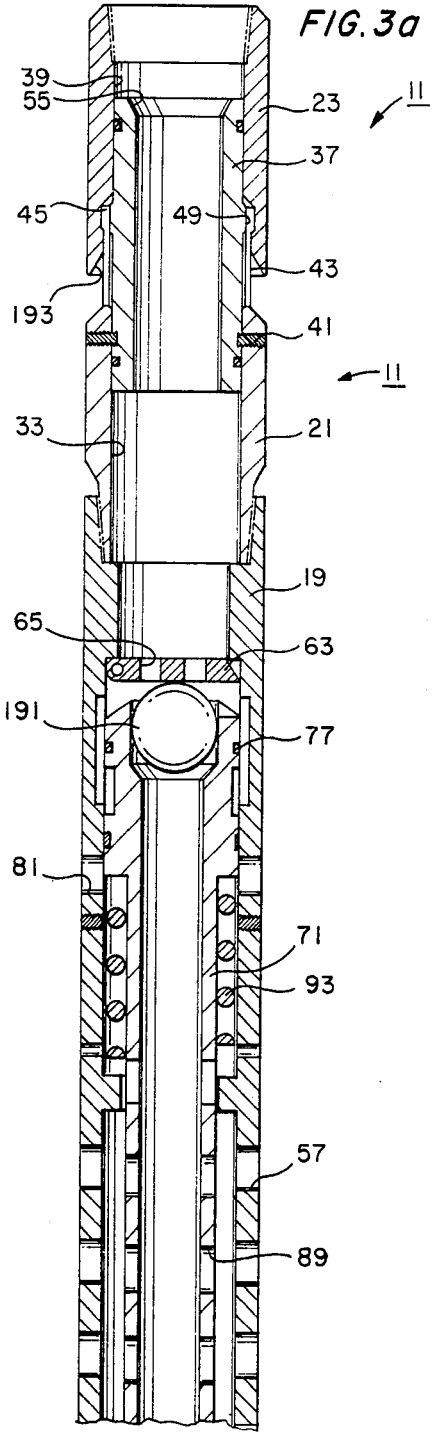
FIG. 3*a* is a side cross-sectional view of the apparatus similar to FIG. 2*a* but showing the apparatus during the firing operation.
Figure 3B:
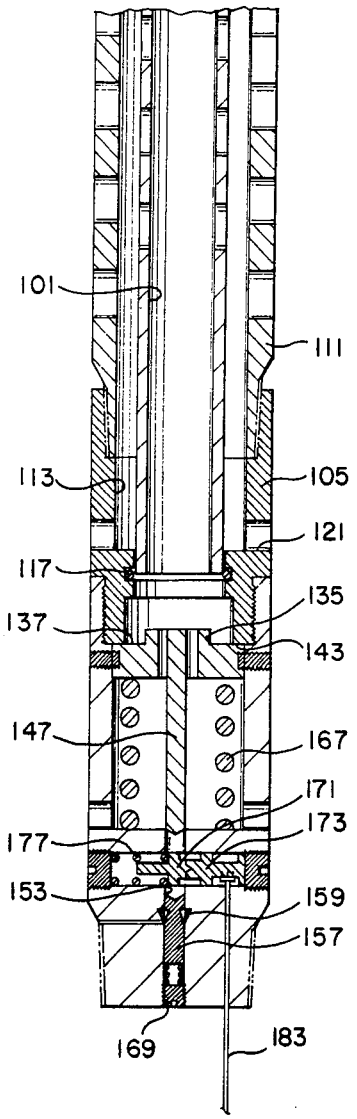
FIG. 3*b* is a downward continuation of FIG. 3*a*.

Pressure in the tubing string above the firing apparatus is then released which allows the coil spring 93 to force the inner mandrel 71 upwardly to the full extent of its travel as shown in FIG. 3*a*. The O-ring seal 77 is now clear of the vent ports 81, allowing communication with the vent ports 57, 89. Debris ports 121 in the connecting sub 105 (FIG. 3*b*) prevent debris from packing off the firing mechanism. As the inner mandrel 71 moves upwardly, the coil spring 167 forces the perforated disc 135 upwardly until the upper surface 137 thereof contacts the lip 143. The lockout member 157 is retained in the position shown in FIG. 3*b* by the dogs 159. As the leg 147 moves upwardly within the longitudinal channel 153, the percussion detonator 173 is uncovered allowing the coil spring 177 to force the detonating pin 171 to come into contact with the percussion cap of the detonator 173 to thereby fire the perforating gun (not shown) located below the firing apparatus via the primer cord 183.

Since fluid pressure in the tubing string 17 has been relieved prior to firing the guns, the under balanced fluid column in the tubing string allows an immediate back-surge of well fluids from the perforations in the well casing 189 and flowing of the well. The flapper valve 63 retains the ball 191 in place but allows fluid flow through the vent ports 65 and upwardly through the tubing string to the well surface.

The firing apparatus 11 can be left in place at the bottom of the well tubing string or can be released from the tubing string if desired. To release the firing apparatus 11, a second larger diameter ball is dropped through the tubing string and seats on the ball seat 55 formed within the shift sleeve 37 (FIG. 3*a*). Pressuring up the tubing string from the surface then causes the shear pins 41 to shear which results in downward sliding movement of the shift sleeve 37 within the bore 33 of the upper end 21. As the raised exterior region 49 of the shift sleeve passes from beneath the collett dog portions 45, the collett fingers 43 fold inwardly, disconnecting the firing apparatus 11 from the upper sub 23 and tubing string leading to the well surface. The firing apparatus 11 and perforating gun are allowed to drop to the bottom of the well. Should the situation demand, the firing apparatus 11 could also be sheared by downward or upward jarring of a wireline tool on the shift sleeve 37. Once the firing apparatus has been released, outer slanting lip 193 of the upper sub 23 serves as a wireline reentry guide and the full bore opening 39 is available for the upward flow of well fluids.

An invention has been provided with significant advantages. The elimination of a dropped bar to fire the tubing conveyed perforating gun provides safety advantages since bar droppers can hang up in the tubing string and later fire at any time when the tubing is being retrieved. Annulus pressure operated firing mechanism can become clogged and present a possible leak path between the tubing interior and the well annulus. Wireline actuated systems are dangerous on occasion due to the under balanced pressure conditions in the well. The present device is, in effect, a triple safety firing system since the system will only fire after dropping a ball, applying tubing pressure, and then releasing tubing pressure. The tubing may thus be safely pulled from the well bore without fear of firing the perforating guns. The side mounted detonator can be armed and disarmed at the drilling rig rotary table while the guns are in the well bore below the surface. The hydromechanical delay system provided by the unique cocking mechanism of the invention eliminates the need for chemical delays which can prove unreliable.

Should the perforating gun fail to fire for any reason, it can be disconnected in the hole by dropping a second ball and further pressuring up the tubing string. Prior tools which featured dropped bars could not be disconnected using wireline tools or by dropping a ball since the tubing bore was obstructed. The present device allows a positive check of the packer setting by pressuring up either the annulus or through the tubing string. The side mounted detonator allows quick replacement or maintenance without disassembling the entire firing apparatus. The hydraulic operation of the device eliminates all wireline runs either to set the packer, fire the guns, or disconnect the guns. The present device can be used with any packoff apparatus including permanent packers, hydraulic retrievable packers, mechanical retrievable packers, and polished bore receptacle seals without modifying the system. The present device retains all the advantages of existing systems such as full back-surge capability and circulation before or after setting the packer while having the added advantages of eliminating wireline trips, providing positive indication of packer setting, providing a triple safety firing system and providing a larger flow area for producing well fluids than annulus pressure firing systems.

While the invention has been shown in only one of its forms, it is not thus limited but is susceptible to various changes and modifications without departing from the spirit thereof.

I claim:

1. A tubing pressurized firing apparatus for a tubing conveyed perforating gun of the type used to perforate a cased well bore, comprising:

a tubular body having an upper end with upper connecting means for connecting said body in a well tubing string and having a lower end with lower connecting means for connecting said body to a well perforating gun;

actuator means located within said tubular body and responsive to changes in pressure within said well tubing string above said tubular body; and cocking means located below said actuator means within said tubular body, said cocking means including a lockout member initially positioned between a detonating pin and a percussion detonator, said cocking means being actuable by said actuator means to move said lockout member from between said detonating pin and percussion detonator as tubing pressure is increased by a predetermined amount whereby subsequent release of tubing pressure exposes said detonating pin to said percussion detonator to actuate said detonator and fire said perforating gun.

2. A tubing pressurized firing apparatus for a tubing conveyed perforating gun of the type used to perforate a cased well bore, comprising:

a tubular body having an upper end with upper connecting means for connecting said body in a well tubing string and having a lower end with lower connecting means for connecting said body to a well perforating gun;

an inner mandrel slidably mounted within said tubular body and sealing engaging said tubular body, said inner mandrel having an interior bore for communicating with said well tubing string above said body, said mandrel interior bore having a ball seat formed therein for receiving a ball dropped through said well tubing string, said ball and ball seat together forming a pressure tight seal whereby tubing pressure in said well tubing string acts on said inner mandrel to slide said mandrel downwardly within said tubular body; and cocking means located below said inner mandrel within said body, said cocking means including a lockout member initially positioned between a detonating pin and a percussion detonator, said cocking means being actuable by downward sliding movement of said inner mandrel to move said lockout member from between said detonating pin and percussion detonator whereby subsequent release of tubing pressure and upward sliding movement of said inner mandrel and cocking means exposes said detonating pin to said percussion detonator to actuate said detonator and fire said perforating gun.

3. The apparatus of claim 2, wherein said tubular body has a ported region which communicates the well bore with the interior of said body and wherein said inner mandrel has a corresponding vented region which communicates the mandrel interior with the body interior and through the body ported region with the well bore.

4. The apparatus of claim 3, wherein said inner mandrel is slidable between a rest position when lesser relative pressure is present in said tubing string and a cocking position when tubing string pressure is increased and wherein said inner mandrel is normally biased toward said rest position.

5. The apparatus of claim 4, further comprising shear means for initially fixing said inner mandrel in said rest position, said shear means being sheared by a predetermined increase in tubing pressure on said ball in said ball seat, thereby allowing said inner mandrel to move downwardly to said cocking position.

6. The apparatus of claim 5, further comprising:

a flapper valve located above said inner mandrel and said ball seat within said tubular body, said flapper valve being movable between a retracted position in engagement with said inner mandrel and an extended position blocking the interior bore of said tubular body.

7. The apparatus of claim 6, wherein downward movement of said inner mandrel disengages said flapper valve, allowing said flapper valve to move to said extended position and thereby prevent upward travel of said ball within said tubing string above said tubular body.

8. A tubing pressurized firing apparatus for a tubing conveyed perforating gun of the type used to perforate a cased well bore, comprising:

a tubular body having an upper end with upper connecting means for connecting said body in a well tubing string and having a lower end with lower connecting means for connecting said body to a well perforating gun;

an inner mandrel slidably mounted within said tubular body and sealing engaging said tubular body, said inner mandrel having an interior bore for communicating with said well tubing string above said body, said mandrel interior bore having a ball seat formed therein for receiving a ball dropped through said well tubing string, said ball and ball seat together forming a pressure tight seal whereby tubing pressure in said wall tubing string acts on said inner mandrel to slide said mandrel downwardly within said tubular body;

cocking means located below said inner mandrel within said body, said cocking means including a lockout member initially positioned between a detonating pin and a percussion detonator, said cocking means being actuable by downward sliding movement of said inner mandrel to move said lockout member from between said detonating pin and percussion detonator whereby subsequent release of tubing pressure and upward sliding movement of said inner mandrel and cocking means exposes said detonating pin to said percussion detonator to actuate said detonator and fire said perforating gun; and wherein said tubular body includes a lower body sub, said lower body sub having an end portion transversed by a longitudinal channel, said channel being located on the longitudinal center line of said tubular body.

9. The apparatus of claim 8, wherein said cocking means includes a perforated disc with an upper surface and a lower surface, said upper disk surface being in contact with and being acted upon by said inner tubular mandrel.

10. The apparatus of claim 9, wherein said perforated disk has a downwardly extending leg located on the lower surface thereof, said leg being slidable within said lower sub channel when said inner mandrel moves downwardly within said tubular body.

11. The apparatus of claim 10, wherein said lockout member is a cylindrical plug slidably mounted below said perforated disk leg within said lower sub channel, said lockout member including an outwardly biased dog for engaging a lockout region of said lower sub channel when said inner mandrel moves downwardly and acts on said perforated disk upper surface.

12. The apparatus of claim 11, wherein said lockout member is normally biased upwardly within said lower sub channel.

13. The apparatus of claim 11, wherein said detonating pin and percussion detonator are side-mounted within said body transverse to the body longitudinal axis.

14. The apparatus of claim 11, wherein said tubular body lower sub has a transverse channel therein which intersects said lower sub channel, said detonating pin and percussion detonator being located within said transverse channel and said lockout member being located between said detonating pin and percussion detonator prior to actuation of said cocking means by an increase in tubing pressure.

15. A tubing pressurized firing apparatus for a tubing conveyed perforating gun of the type used to perforate a cased well bore, comprising:

a tubular body having an upper end with upper connecting means for connecting said body in a well tubing string and having a lower end with lower connecting means for connecting said body to a well perforating gun;

an inner mandrel slidably mounted within said tubular body and sealing engaging said tubular body, said inner mandrel having an interior bore for communicating with said well tubing string above said body, said mandrel interior bore having a ball seat formed therein for receiving a ball dropped through said well tubing string, said ball and ball seat together forming a pressure tight seal whereby tubing pressure in said well tubing string acts on said inner mandrel to slide said mandrel downwardly within said tubular body;

cocking means located below said inner mandrel within said body, said cocking means including a lockout member initially positioned between a detonating pin and a percussion detonator, said cocking means being actuable by downward sliding movement of said inner mandrel to move said lockout member from between said detonating pin and percussion detonator whereby subsequent release of tubing pressure and upward sliding movement of said inner mandrel and cocking means exposes said detonating pin to said percussion detonator to actuate said detonator and fire said perforating gun; and pressure actuated disconnect means as a part of said upper connecting means for releasing said appartaus from said well tubing string upon a predetermined increase in pressure within said tubing string.

16. The apparatus of claim 15, wherein said pressure actuated disconnect means including a cylindrical shift sleeve having an interior bore, said shift sleeve being connected by shear means to said tubular body and said shift sleeve interior bore having a ball seat formed therein for receiving and sealably engaging a ball dropped through said tubing string, said ball seat being of greater relative diameter than said inner mandrel ball seat, said shift sleeve including seal means in the exterior surface thereof for slidably sealing againsts the interior bore of said tubular body when said shear means is sheared by a predetermined increase in tubing pressure on said shift sleeve ball.

17. The appartaus of claim 16, wherein said disconnect means further comprises a detent means carried by said tubular body and received with a recess in said well tubing string interior, said shift sleeve having a raised exterior region which underlies and retains said detent means within said tubing recess until said predetermined increase in tubing pressure shears said shear means and, in turn, moves said raised exterior region from beneath said detent means to release said apparatus from said well tubing string.

18. A method of firing a well tubing conveyed perforating gun of the type used to perforate a cased well bore, comprising the steps of:

providing a tubing pressurized firing apparatus between said tubing string and said perforating gun in said well tubing string said firing apparatus including a pressure responsive actuator means responsive to changes in pressure within said tubing string;

providing cocking means within said firing apparatus, said cocking means including a lockout member initially positioned between a detonating pin and a percussion detonator, said cocking means being actuable by said actuator means to move said lockout member from between said detonating pin and percussion detonator as tubing pressure is increased by a predetermined amount whereby subsequent release of tubing pressure exposes said detonating pin to said percussion detonator to actuate said detonator and fire said perforating gun;

running said firing apparatus to a selected depth within the well bore on said well tubing string;

increasing the pressure within the tubing string by a predetermined amount to cock said apparatus; and decreasing the pressure within the tubing string by a predetermined amount to fire the perforating gun.

19. The method of claim 18, further comprising the steps of mounting hydraulic packet means on said tubing string, said packer means being actuated by an increase in pressure in said tubing string to expand radially outward from said tubing string and seal-off said well bore above said firing apparatus.

20. The method of claim 19, wherein said predetermined pressure increase for actuating said cocking means is greater than the pressure increase needed to actuate said packer means whereby a gradual increase in tubing string pressure sets said packer means in one step and actuates said cocking means in a subsequent step.

21. A method of firing a well tubing conveyed perforating gun of the type used to perforate a cased well bore, comprising the steps of:

providing a tubing pressurized firing apparatus between said tubing string and said perforating gun in said well tubing string, said firing apparatus including a pressure responsive actuator means responsive to changes in pressure within said tubing string;

providing cocking means within said firing apparatus, said cocking means being actuable by said actuator means as tubing pressure is increased from the well surface by a predetermined amount to cock said firing apparatus, whereby subsequent release of tubing pressure serves to fire said perforating gun;

running said firing apparatus to a selected depth within the well bore on said well tubing string;

dropping a ball through the tubing string from the surface to a ball seat provided as a part of the actuator means to thereby block off communication between the tubing string above the ball and the well annulus;

increasing the pressure within the tubing string from the well surface by a predetermined amount to cock said apparatus; and decreasing the pressure within the tubing string by a predetermined amount to fire the perforating gun.

22. A method of firing a well tubing conveyed perforating gun of the type used to perforate a cased well bore, comprising the steps of:

providing a tubing conveyed firing apparatus in said well tubing string above said perforating gun, said firing apparatus being provided with an inner mandrel having a ball seat for engaging a ball dropped through said tubing string from the surface;

providing cocking means within said firing apparatus actuable by movement of said inner mandrel to cock said firing apparatus;

running said firing apparatus to a selected depth within the well bore;

circulating fluids downwardly within said tubing string, once the selected depth is reached, and out through vent ports provided in the tubing string into the well annulus to provide the desired hydrostatic head within the well bore;

dropping a ball through said tubing string from the surface to said ball seat to thereby block off communication with the well annulus through said vent ports;

pressuring up the tubing string from the surface to a first level;

raising the pressure inside the tubing string to a second level, higher than the first, to move the inner mandrel and cock the firing mechanism; and decreasing the pressure within the tubing string to fire the perforating gun.

23. A method of firing a well tubing conveyed perforating gun of the type used to perforate a cased well bore, the tubing string including a packer for sealing the annular space between the tubing string and the surrounding casing:

providing a tubing conveyed firing apparatus in said well tubing string above said perforating gun, said firing apparatus being provided with an inner mandrel having a ball seat for engaging a ball dropped through said tubing string from the surface;

providing cocking means within said firing apparatus actuable by movement of said inner mandrel to cock said firing apparatus;

running said firing apparatus to a selected depth within the well bore while allowing well fluids to circulate through vent ports provided in the tubing string to fill the tubing string;

circulating fluids downwardly within said tubing string, once the selected depth is reached, and out through said vent ports into the well annulus to provide the desired hydrostatic head within the well bore;

dropping a ball through said tubing string from the surface to said ball seat to thereby block off communication with the well annulus through said vent ports;

pressuring up the tubing string from the surface to a first level to set the packer;

raising the pressure inside the tubing string to a second level, higher than the first, to move the inner mandrel and cock the firing mechanism; and decreasing the pressure within the tubing string to fire the perforating gun.

* * * * *